United States Patent [19]

Pirkle

[11] Patent Number: 4,883,082

[45] Date of Patent: Nov. 28, 1989

[54] TEMPERATURE-RESPONSIVE VALVE

[76] Inventor: Fred L. Pirkle, Box 27, Oreland, Pa. 19075

[21] Appl. No.: 328,858

[22] Filed: Mar. 27, 1989

Related U.S. Application Data

[63] Continuation-in-part of Ser. No. 194,164, May 16, 1988, Pat. No. 4,815,491.

[51] Int. Cl.[4] ..... F16K 31/64; F16K 17/40; E03B 7/12

[52] U.S. Cl. ..... 137/62; 137/79; 137/315; 138/32; 236/100; 237/80; 251/74; 251/291; 251/297; 251/11

[58] Field of Search ..... 137/59, 62, 79, 315, 137/468; 60/527; 138/27, 28, 32, 34, 34.5; 236/34.5, 42, 43, 48 R, 100; 237/80; 251/11, 66, 67, 74, 75, 291, 297

[56] References Cited

U.S. PATENT DOCUMENTS

| | | | |
|---|---|---|---|
| 2,788,176 | 4/1957 | Andersen | 236/34.5 |
| 3,313,483 | 4/1967 | Nallinger | 236/34.5 |
| 3,768,731 | 10/1973 | Lavado | 236/34.5 |
| 3,989,058 | 11/1976 | Jackson et al. | 251/11 |
| 4,361,167 | 11/1982 | Harasewych | 137/62 |
| 4,438,777 | 3/1984 | Pirkle | 137/62 |
| 4,460,007 | 7/1984 | Pirkle | 137/62 |
| 4,484,594 | 11/1984 | Alderman | 137/62 |
| 4,606,302 | 8/1986 | Huemer et al. | 236/34.5 |
| 4,809,727 | 3/1989 | Chamberlin | 137/62 |

*Primary Examiner*—George L. Walton
*Attorney, Agent, or Firm*—Howson & Howson

[57] ABSTRACT

A temperature-responsive valve comprises a pair of wax-filled thermal actuators connected in series and set to expand at different temperatures respectively at the high and low limits of a temperature range. In one version, a valve element is movable by the actuators through an orifice form one side thereof to the other, closing the orifice when in an intermediate position, and opening the orifice when one actuator expands and when the other actuator contracts. The actuators are both in contact with the fluid controlled by the valve in the first version. In a second version, one of the actuators is isolated from the controlled fluid and responsive to the ambient temperature. In a third version, the valve is a snap-action valve, in which the series actuators operate a cam which normally holds latching balls in a projecting condition in which they engage a detent to hold the valve element closed. The valve element snaps open and remains open when one of the actuators expands and also when the other actuator contracts.

6 Claims, 3 Drawing Sheets

TEMPERATURE-RESPONSIVE VALVE

CROSS-REFERENCE TO RELATED APPLICATIONS

This is a continuation-in-part of my application Ser. No. 194,164, filed May 16, 1988, now U.S. Pat. No. 4,815,491, issued Mar. 28, 1989.

BRIEF SUMMARY OF THE INVENTION

This invention relates to temperature-responsive valves, and more particularly to a valve which is normally closed, but which opens under both high and low temperature conditions. The invention has utility in many applications, for example, in outdoor safety showers and eye wash stations in chemical plants, where it is necessary to protect the water lines against freezing, and also to prevent the water supply from reaching scalding temperatures as a result of heating of the water lines by sunlight.

In the past, separate safety devices were considered necessary to protect water lines against freezing and overheating. This led to high installation costs and also to high expenditures for maintenance in order to insure reliability.

The principal object of the present invention is to provide a simple, reliable, easily replaced unit, which provides protection against both low and high temperature conditions in a liquid system. A further object of the invention to provide a simple, reliable, easily replaced unit, which provides protection against freezing in a water supply system and which also protects the system against excessive temperatures.

The invention is a temperature-responsive valve in which flow of liquid takes place through an orifice, normally closed by a valve element. First and second temperature-sensitive expansible actuators, typically wax-filled thermal actuators, are set to expand at different temperatures. In the case where protection of a water system against freezing and scalding temperatures is desired, one of the actuators is set to expand at a temperature slightly above the freezing point so that it is normally expanded, and contracts when freezing temperatures are encountered. The other actuator is set to expand at a much higher temperature, i.e. at a temperature just below the temperature at which the water could cause injury by scalding. This second actuator is then normally in its contracted condition while the first actuator is normally in its expanded condition. The actuators are connected in series with each other and cause the valve element to open the orifice when the high temperature actuator expands, and also cause the valve element to open the orifice when the low temperature actuator contracts.

In a preferred form of the invention, the valve element is connected in series with the two actuators and arranged to move along an axis through the orifice from an upstream side thereof to a downstream side. A seal, associated with said valve element and with the orifice, prevents flow from taking place through the orifice when the valve element is within a limited range of positions between the upstream and downstream sides. The actuators and the valve element are arranged so that the valve element is in this limited range of positions when the low temperature actuator is in its expanded condition and the high temperature actuator is in its contracted condition.

Both of the actuators may be in contact with fluid on the one side of the orifice, either the upstream side or the downstream side. Alternatively, one of the actuators may be in contact with fluid on one side of the orifice while the other actuator is isolated from the fluid and responsive to ambient temperature.

In one form of the invention, a triggerable latching device normally holds the valve element in a position to close the orifice. This triggerable latching device is responsive to the actuators, and releases the valve element, causing the valve element to open the orifice when one of the actuators expands and also when the other of the actuators contracts. The triggerable latching device preferably comprises a fixed detent, a set of radially movable balls carried with the valve element and cooperable with the detent to maintain the valve element in position to close the orifice when the balls are in a radially projecting condition, and a cam operated by the actuators and having a surface engageable with the balls for normally maintaining the balls in their projecting condition. The cam has recesses on both sides of the ball-engaging surface in the direction of cam movement for allowing retraction of the balls when the cam moves in one direction upon contraction of one of the actuators, and also when the cam moves in the opposite direction upon expansion of the other actuator.

In each case, by virtue of the two actuators connected in series with each other and set to expand at different temperatures, a single valve element and a single orifice are made to open both at high and low temperatures, while remaining closed at intermediate temperatures. The assembly comprising the actuators and valve element can be easily replaced as a unit. Thus, the invention provides a simple, reliable, inexpensive and easily maintained temperature-responsive valve capable of opening at both low and high temperatures.

Other objects and advantages of the invention will be apparent from the following detailed description when read in conjunction with the drawings.

DETAILED DESCRIPTION

Figure 1:
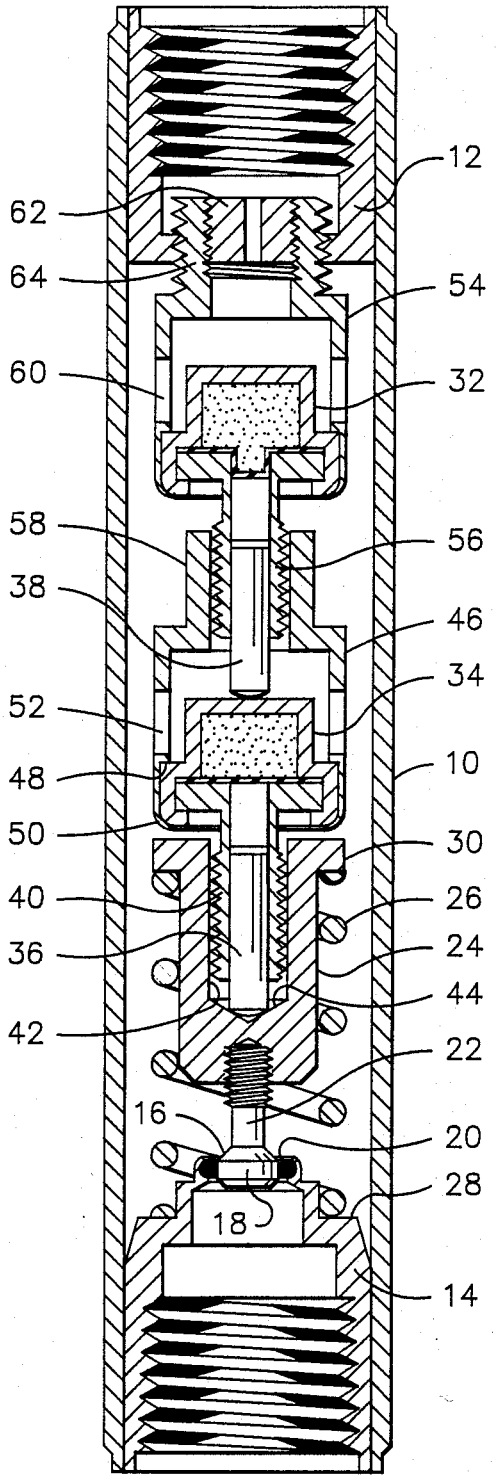
FIG. 1 is an axial section through a modulating-type temperature-responsive valve in accordance with a first embodiment of the invention.

The valve of FIG. 1 comprises an elongated cylindrical housing 10 having internally threaded inserts 12 and 14 fixed at its opposite ends for connection of the valve into a fluid system. A valve element 16 is shown located in an orifice formed at the upper end of insert 14. The valve element 16 has a cylindrical part 18, which cooperates with an O-ring seal 20 to prevent flow of liquid through the orifice. Frusto-conical parts are formed above and below the cylindrical part 18. The valve element is movable through the orifice, and allows flow to take place when on either side of the orifice but prevents flow when in a limited range of positions including the position in which it is shown.

The valve element 16 has a threaded stem 22, which is threaded into a flanged, cup-shaped element 24. A coil spring 26 is held in compression between a shoulder 28 of insert 14 and a flange 30 of element 24, and urges the valve element upwardly. Upward movement of the valve element, however, is resisted by an assembly comprising a pair of temperature-responsive actuators 32 and 34 connected in series.

In the embodiment shown, each of actuators 32 and 34 is a wax-filled, temperature responsive actuator having a piston which automatically extends when the temperature of the actuator body rises above a predetermined critical temperature. The critical temperature of each actuator is controlled by the selection of an appropriate wax composition. In the valve shown in FIG. 1, the critical temperature of actuator 32 is below the critical temperature of actuator 34, and the temperature of the fluid within housing 10 is between the critical temperatures of the actuators. Thus, the piston 36 of actuator 34 is retracted while the piston 38 of actuator 32 is extended.

The stem 40 of actuator 34 slides into the cylindrical internal surface 42 of cup-shaped element 24 so that actuator 34 and element 24 guide each other. Piston 36 constantly engages the floor 44 of the interior of element 24.

The body of actuator 34 is rigidly secured in a holder 46 between an internal shoulder 48 and a crimped portion 50 of the holder at its lower end. Openings 52 in holder 46 allow fluid within housing 10 to come into contact with the actuator body.

Actuator 32 is secured in a holder 54, which is similar to holder 46. The stem 56 of actuator 32 slides in a cylindrical passage in the neck 58 of holder 46, and the lower end of its piston 38 bears against the top of actuator 34. Openings 60 in holder 54 allow fluid to flow between the interior and exterior of the holder. Holder 54 is threaded into insert 12 at the upper end of the assembly, and a flow-limiting orifice 62 is threaded into the neck 64 of holder 54.

The operation of the valve is essentially as follows. Normally, the piston 38 of the low temperature actuator 32 is extended and the piston 36 of the high temperature actuator 34 is retracted. The valve element 16 is positioned as shown in FIG. 1, with its cylindrical surface 18 in sealing relationship with the orifice sealing ring 20. A water supply for a shower head is also connected, via a T-fitting, to insert 12 at the upper end of the assembly, and the lower insert 14, at the opposite end, is connected to a drain.

If the temperature of the water within housing 10 falls below the critical temperature of actuator 32, its piston 38 retracts, allowing spring 26 to push upwardly on cup element 24, moving the valve element 16 upwardly through the orifice to open the orifice. The valve operates within the hysteresis range of actuator 32 in a self-limiting manner in that, when the supply water reaching the actuator 32 becomes warmer, valve element 16 moves toward its closed condition, thereby reducing the rate of flow, and ultimately shutting off flow through the valve entirely. If the temperature of the water in contact with actuator 32 again decreases, the valve opens slightly to increase the rate of flow. Thus, rate of flow of water is dependent on the temperature of the supply, and waste of water is minimized. The temperature of the water within housing 10, therefore, will not normally fall below the critical temperature of actuator 32. Under severe low temperature conditions, the temperature of the supply lines may actually fall below freezing. However, the slow flow of water allowed by the valve prevents the water supply lines from freezing.

If the water in the supply becomes excessively hot, for example by reason of heating by sunlight falling on water supply lines, piston 36 of actuator 34 extends, causing cup element 24 to move downwardly so that valve element 16 moves downwardly through the orifice to allow flow to take place. Cooler water, from portions of the supply system not exposed to sunlight, replaces the hot water, and valve element 16 moves toward its closed condition, reducing the flow rate and ultimately shutting off flow. The temperature of the water within housing 10 is essentially limited to the critical temperature of actuator 34 without excessive waste of water.

The valve assembly of FIG. 1 can be reversed in the water supply line so that insert 14 is connected to the supply and insert 12 is connected to a drain. The valve assembly operates in a similar manner if connected in the reverse direction, but is more sensitive to ambient temperature and less sensitive to fluid temperature. Otherwise, it makes little difference whether the actuators are on the upstream or downstream side of the orifice.

Figure 2:
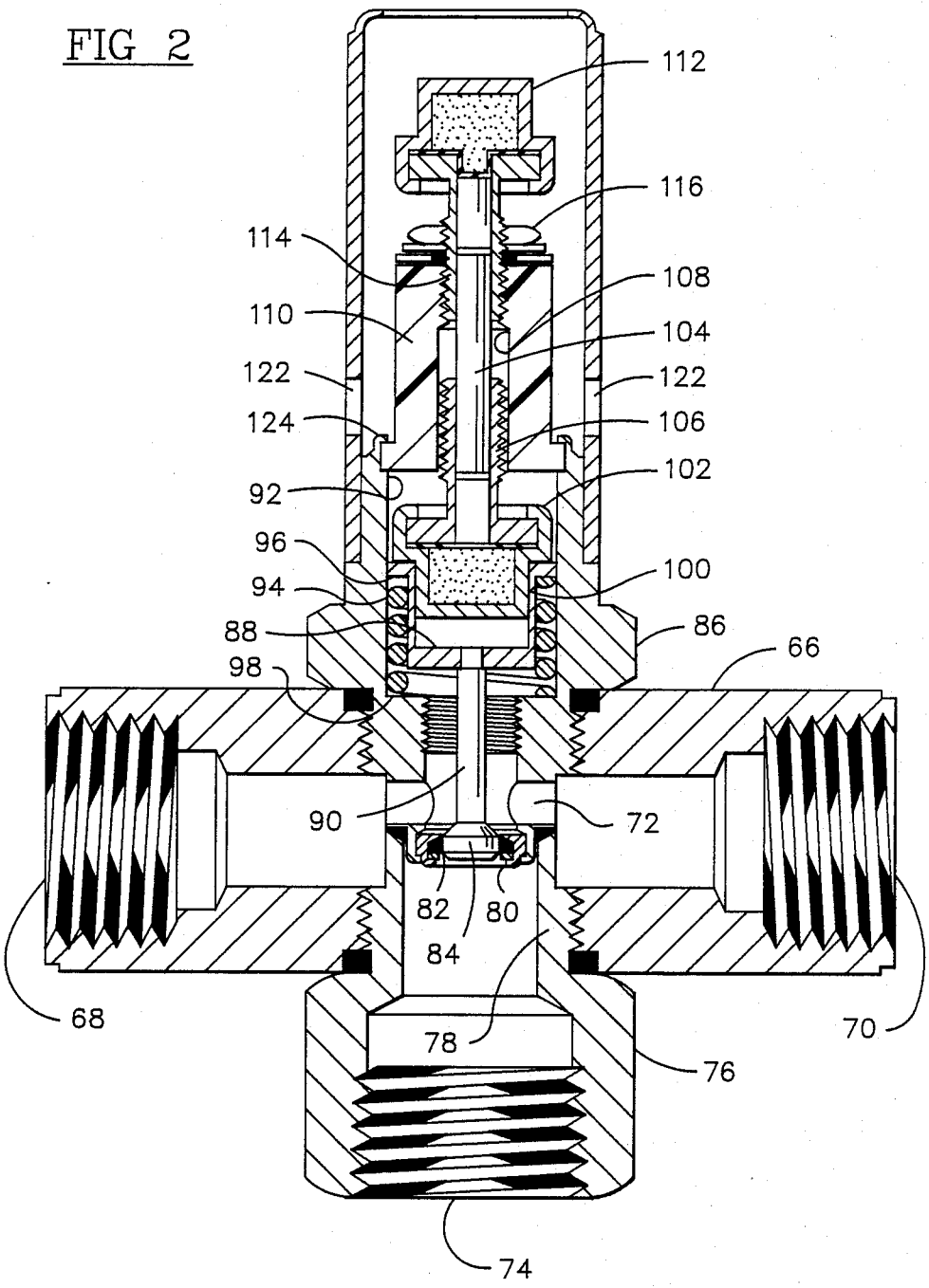
FIG. 2 is an axial section through a modulating-type valve in accordance with a second embodiment of the invention.

In the embodiment of the invention shown in FIG. 2, a three port valve body 66 is provided, having an inlet port 68, an outlet port 70 continuously connected to the inlet port through a passage 72, and a drain port 74. The drain port is provided by an element 76 having a neck 78 which is threaded into a lower part of the valve body. An orifice assembly 80 is provided, having a sealing ring 82 which cooperates with a valve element 84 similar to valve element 16 of FIG. 1. As in the case of FIG. 1, the valve element 84 is movable through the orifice from an upstream side to a downstream side of the orifice, and cooperates with the sealing ring to prevent flow of fluid through the orifice when valve element 84 is within a limited range of positions between the upstream and downstream sides of the orifice.

A removable cartridge 86 is threaded into an upper part of the valve body 66. The orifice assembly 80 is part of this cartridge. A flanged receiver 88 is connected to the upper end of a stem 90 of valve element 84, and is slidable in a cylindrical passage 92 of cartridge 86. A coil spring 94 is held in compression between a flange 96 formed at the upper end of receiver 88, and an annular surface 98 inside the cartridge. The spring thus urges the receiver 88 upwardly. The body 100 of an actuator 102 is held in the upper end of the receiver 88, and the piston 104 of the actuator extends upwardly through the actuator stem 106 and into stem 114 of actuator 112. The body 100 of the actuator is exposed to fluid in passage 72 by reason of leakage past between receiver flange 96 and the cylindrical wall of passage 92, and heat is also conducted from the actuator to the fluid through the receiver 88. However special passages for flow of fluid to the vicinity of the actuator body can be provided, if desired.

Stem 106 of actuator 102 is slidable in a cylindrical passage 108 formed in an element 110 of a synthetic resin material. Element 110 has a second actuator 112, the stem 114 of which is threaded into its upper end and secured by a nut 116. Openings 122 are provided in the outer wall of cartridge 86 in order to expose actuator 112 to ambient air. Another opening is provided in the end of the cartridge. Element 110 is secured to cartridge 86 at 124, and prevents fluid from leaking out of the space surrounding actuator 102. Actuator 112, which is the low temperature actuator, is thus responsive primarily to the temperature of the ambient atmosphere while actuator 102, which is the high temperature actuator is primarily responsive to the temperature of the fluid in passage 72.

As in the case of FIG. 1, the actuators of FIG. 2 are effectively connected in series. Retraction of piston 104 into actuator 112, which occurs as a result of low ambient temperatures, allows the coil spring 94 to push upwardly on receiver 88, thereby causing the valve element 84 to move upwardly through the orifice. Fluid temperatures exceeding the critical temperature of actuator 102 cause piston 104 to be extended from actuator 102, thereby moving receiver 88 downwardly and opening the orifice by moving valve element 84 downwardly through the orifice.

In the case of high fluid temperatures, the mechanism is self-limiting because the high-temperature actuator 102 is responsive to the temperature of the fluid being controlled. In the case of low ambient temperatures, however, since the low-temperature actuator 112 is isolated from the controlled fluid, the orifice remains open and allows flow to continue until the ambient temperature returns to a level above the critical temperature of actuator 112. The low temperature actuator 112 is especially sensitive to changes in ambient temperature, and therefore the configuration of FIG. 2 is particularly useful where rapid drops in temperature are encountered.

Figure 3:
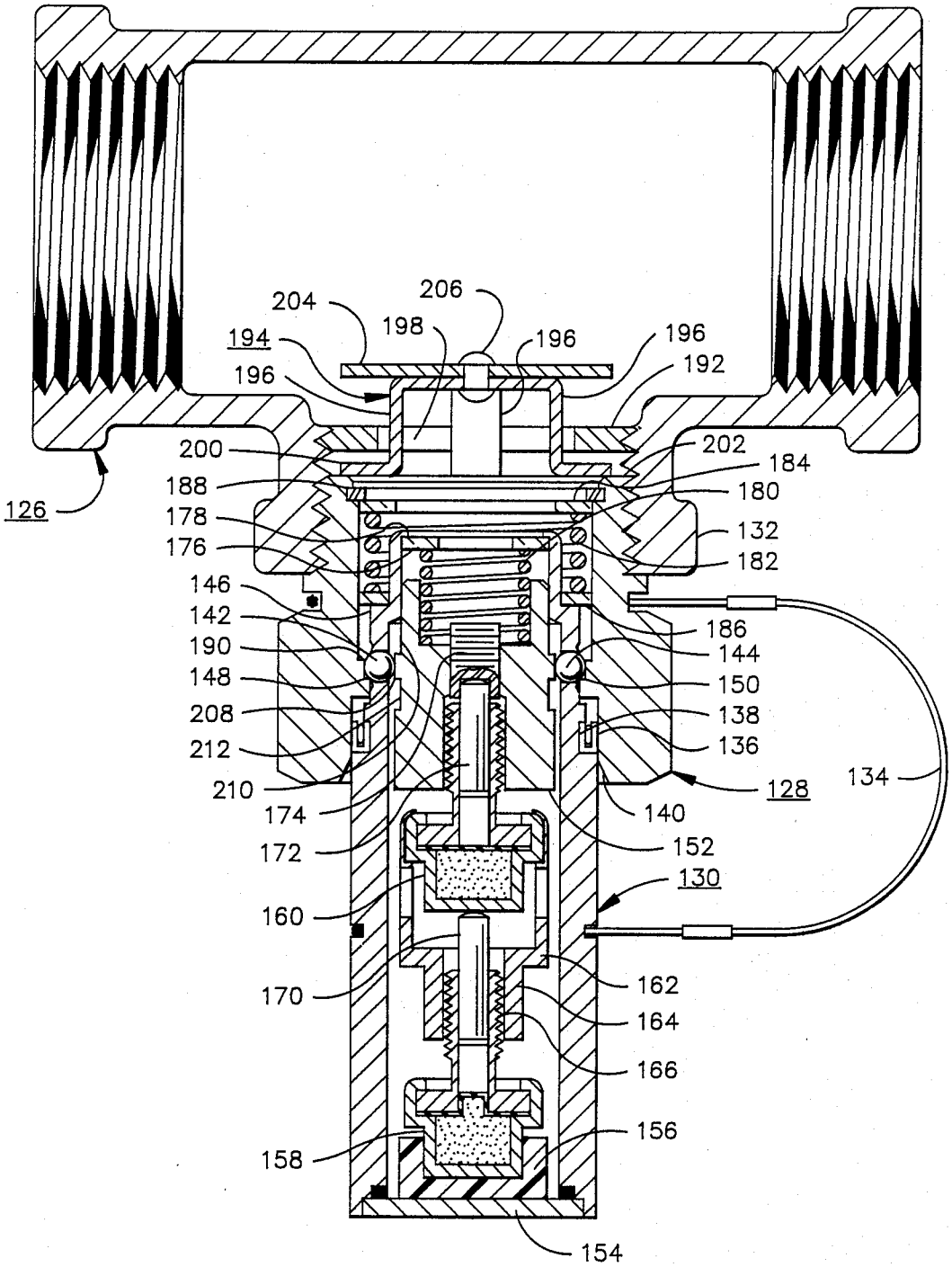
FIG. 3 is an axial section through a snap-action valve in accordance with a third embodiment of the invention.

The embodiment of FIG. 3 is a snap-action drain valve which remains closed when the controlled fluid is in a range of temperatures between a high limit and a low limit, but opens when temperatures outside that range are encountered.

The device of FIG. 3 comprises, as its principal parts, a T-fitting 126, a bushing 128 and a plug 130. The T-fitting forms part of a liquid system, and the bushing 128 is threaded into the neck 132 of the T-fitting. The plug 130 extends into the bushing and is normally in the position shown. However, the plug is removable from the bushing. A flexible lanyard 134, of stranded metal wire or plastic material, has a loop at one end connected to a groove in the bushing and a loop at its other end connected to a groove in the plug. The lanyard is of a length such that it allows the plug to disengage completely from the bushing. The loop of the lanyard which attaches to the plug 130 is of tear-drop shape and is of a size such that, when it is manually brought to a circular condition, its inner diameter is slightly greater than the outer diameter of the plug. This allows the plug to be removed from the lanyard by deliberate manipulation, yet prevents inadvertent disengagement of the plug from the lanyard.

The plug is provided with an annular seal 136 which is held in a groove 138 formed in the outer surface of the plug. The seal is a hydraulically energized, low break-out seal having an outer sealing lip which is urged radially outwardly by liquid pressure into tight engagement with the cylindrical inner wall 140 of bushing 128. The seal comprises a machined ring of PTFE having a U-shaped cross-section and narrow sealing lips. A metallic spring is provided between the inner and outer lips to maintain the lips in engagement with the cylindrical surfaces to be sealed, even when liquid pressure is not applied. A suitable low break-out seal is manufactured by American Variseal of 510 Burbank St., P.O. Box 1479. Broomfield, Colo. 80020.

Balls 142 and 144 are two of a series of metal balls which extend outwardly through radial openings in the wall of the plug. The device shown uses four balls. However, as few as three balls, or larger numbers of balls, can be used. The radial openings are staked, i.e. provided with swaged indentations, so that their outer ends are slightly smaller in diameter than the balls and the balls are held captive but are nevertheless able to protrude beyond the cylindrical outer surface 146 of the plug to engage ledges 148 and 150 respectively, which are formed on the inner wall of bushing 128. The balls are maintained in the outwardly protruding condition depicted in FIG. 3 by cam 152, which is axially slidable in the interior of the plug. The lower end of the plug is closed by a disc 154, which is held in place by a force fit, and sealed by means of an O-ring. The disc carries a seat 156 which holds a wax-filled thermal actuator 158. Seat 156 can be made of a suitable insulating material, such as a foamed polymer, to isolate the actuator partly from ambient temperatures. Alternatively, the seat can be thermally conductive so that the actuator is partially responsive to outside temperatures.

A second actuator 160 is held in a carrier 162, which has a downwardly extending neck 164 slidably receiving the stem 166 of actuator 158. Piston 170 of actuator 158 is in contact with the body of actuator 160, and the stem of actuator 160 extends into a cylindrical passage in cam 152. The piston 172 of actuator 160 is in contact with an adjusting screw 174 threaded into cam 152. This adjusting screw is accessible through an opening in a spring-retaining washer 176. Washer 176 is held in the upper end of the plug by a small retaining flange 178 formed at the upper end of the plug. A spring 180 is held in compression between washer 176 and the lower end of a recess formed in the upper end of cam 152. Spring 180 urges the cam downwardly against the piston 172 of actuator 160. When the piston 170 of actuator 158 retracts when the temperature of actuator 158 falls, cam 152 moves downwardly.

A coil spring 182 is held in compression between upper and lower retaining rings 184 and 186 Spring 182 is preferably designed to exert an axial force about four to five times the break-out force for seal 136. The lower retaining ring rests on a shoulder of the plug, and preferably fits tightly between the plug and the inner wall of bushing 128 so that it serves as a trash seal, preventing solid matter in the protected fluid system from reaching the balls which hold the plug in place. The upper ring 184 is held against upward movement by snap ring 188, which fits into a groove in the inner wall of bushing 128 near its upper end. Spring 182 is held captive in bushing 128 because its upper retaining ring 184 is held by snap ring 188 and because downward movement of its lower retaining ring 186 is limited by a shoulder 190 formed in the inner wall of the bushing just above the level of the ball-retaining ledges 148 and 150.

Ring 184 serves not only as a retaining ring for spring 182, but also to provide a flow-restricting orifice, the size of which can be chosen for reduced flow or for any desired flow coefficient $C_v$. Flow restriction is necessary when the device of FIG. 3 is used for freeze protection of a pipe system which cannot be completely drained, for example a water main on a dock, or in a roadway tunnel. The flow-restricting orifice can be chosen to permit just enough flow to prevent freezing.

A ring 192 is threaded into neck 132 of the T-fitting above, and spaced from, the upper end of bushing 128. A four-legged spider 194 has legs 196, which extend through an opening 198 in the ring, and feet 200, which extend outwardly from the lower ends of the legs so that the spider is supported on the upper end 202 of the bushing. A disc 204 is secured to the spider by a rivet 206. This disc is larger in diameter than opening 198 of the ring, and can be made of metal or a relatively rigid polymer. It serves as a closure to prevent the escape of water from the protected system when the bushing is removed from the T-fitting. The disc and spider assembly are actuated both by gravity and by the outward flow of water when the bushing is removed. A spring (not shown), urging the disc toward the opening in ring 192, can be provided, and is desirable when the protective plug assembly extends in a direction other than directly downward.

The plug is insertable into, and removable from, the bushing by virtue of the cooperation of the balls of the plug with J-shaped grooves formed in the inner wall of the bushing. The balls and J-shaped grooves provide a bayonet coupling allowing the plug to be quickly engaged in the bushing without the need for any tools. For further details of the bayonet coupling, reference should be made to my U.S. Pat. No. 4,815,491, the disclosure of which is here incorporated by reference.

Cam 152 has a ball-engaging surface 208 shown in contact with the balls. The cam has reduced-diameter surfaces 210 and 212 above and below surface 208 respectively, so that the balls are permitted to move inwardly to disengage shoulders 148 and 150 not only when the cam 152 moves downwardly from the position shown, but also when it moves upwardly. For example, if actuator 158 is designed to retract its piston at a temperature of 34° F. and actuator 160 is designed to extend its piston at a temperature of 200° F., at intermediate temperatures, actuator 158 will be extended and actuator 160 will be retracted. The cam 152 is adjusted by its adjusting screw 174 so that cam surface 208 is in register with the balls. If the temperature falls below 34°, actuator 158 will retract, allowing the cam to move downwardly, and thereby allowing the balls to move inwardly, releasing the plug from the bushing. Similarly, if the temperature rises above 200°, actuator 160 will extend its piston, causing the cam to move upwardly. Again the balls are allowed to move inwardly, releasing the plug.

Thus, the mechanism of FIG. 3 serves as a snap-action drain valve, remaining closed when temperatures are within a selected range, but opening automatically when the temperature falls below the lower limit of the range, or rises above the upper limit. The dual actuator plug can be easily replaced to change the upper and lower temperature limits simultaneously, and can be readily substituted for a single-actuator plug.

All three versions of the temperature-responsive valve are structurally simple, reliable, inexpensive and easily maintained. Each provides the system in which it is installed with protection against both high and low temperature extremes, without the need for complex connections to fluid lines. Many modifications can be made to the embodiments disclosed, for example in the arrangement of the series-connected actuators, and in the specific design of the valve element and orifice. Furthermore actuators such as bellows actuators can be used instead of the wax actuators specifically shown. Other modifications can be made to the apparatus disclosed without departing from the scope of the invention as defined in the following claims.

I claim:

1. A temperature-responsive valve comprising means providing first and second ports with a flow path extending therebetween, means comprising a valve element for closing said flow path, and temperature-responsive means, comprising first and second temperature-sensitive expansible actuators connected in series with each other and set to expand at different temperatures, for causing said valve element to open said flow path when one of said actuators expands, and also causing said valve element to open said flow path when the other of said actuators contracts, said actuators having a stable condition in an intermediate range of temperatures between said different temperatures, said flow path having an orifice, said temperature-responsive means including means, connected to said valve element and responsive to expansion and contraction of said actuators, for causing said valve element to move through said orifice from one side thereof to the other, and said actuators and valve element being arranged so that said valve element is located on one side of said orifice, when said one of said actuators expands, to permit fluid flow in said flow path, so that said valve element is located on the opposite side of said orifice, when other of said actuators contracts, to permit fluid flow in said flow path, and so that said valve element is located in said orifice to shut off flow in said flow path when said one of said actuators is contracted and said other of said actuators is expanded.

2. A temperature-responsive valve according to claim 1 in which said valve element is connected in series with said actuators, and having sealing means, associated with said valve element and with said orifice, for preventing flow through said orifice when the valve element is within a limited range of positions between said one side thereof and the other, said actuators and said valve element being arranged so that said valve element is in said limited range of positions when said one of the actuators is in an expanded condition and said other of the actuators is in a contracted condition.

3. A temperature-responsive valve according to claim 1 in which both of said actuators are located to be in contact with fluid on one side of said orifice.

4. A temperature-responsive valve according to claim 1 in which one of said actuators is located to be in contact with fluid on one side of said orifice and the other of said actuators is isolated from said fluid and arranged to be responsive to ambient temperature.

5. A temperature-responsive valve comprising means providing first and second ports with a flow path extending therebetween, means comprising a valve element for closing said flow path, and temperature-responsive means, comprising first and second temperature-responsive expansible actuators connected in series with each other and set to expand at different temperatures, for causing said valve element to open said flow path when one of said actuators expands, and also causing said valve element to open said flow path when the other of said actuators contracts, said actuators having a stable condition is an intermediate range of temperatures between said different temperatures, in which said temperature-responsive means comprises triggerable means, responsive to movement of said actuators, for normally holding said valve element in a position to close said flow path said triggerable means being responsive to said actuators, for releasing said valve element and causing said valve element to open said flow path when one of the actuators expands at one of said different temperatures and also when the other of the actuators contracts at the other of said different temperatures.

6. A temperature-responsive valve according to claim 5 in which said triggerable means comprises fixed detent means, a set of radially movable balls carried with said valve element and cooperable with said detent means to maintain said valve element in position to close said flow path when said balls are in a radially projecting position, and cam means, connected to be operated by said actuators, and having a surface engageable with said balls for normally maintaining said balls in said projecting condition, said cam means having recess means on both sides of said surface in the direction of cam movement for allowing retraction of said balls when the cam means moves in one direction upon contraction of one of the actuators, and also when the cam means moves in the opposite direction upon expansion of the other of said actuators.

* * * * *